US009599412B2

(12) United States Patent
Garret et al.

(10) Patent No.: US 9,599,412 B2
(45) Date of Patent: Mar. 21, 2017

(54) HEAT EXCHANGER AND CASING FOR THE EXCHANGER

(75) Inventors: Paul Garret, Veneux les Sablons (FR); Yoann Naudin, Saint-Loup-en-Champagne (FR); Philippe Faille, Reims (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 1114 days.

(21) Appl. No.: 13/001,336

(22) PCT Filed: Jun. 22, 2009

(86) PCT No.: PCT/EP2009/057741

§ 371 (c)(1),
(2), (4) Date: Mar. 23, 2011

(87) PCT Pub. No.: WO2009/156364

PCT Pub. Date: Dec. 30, 2009

(65) Prior Publication Data

US 2011/0162826 A1 Jul. 7, 2011

(30) Foreign Application Priority Data

Jun. 26, 2008 (FR) ..... 08 03600
Jun. 22, 2009 (WO) ..... PCT/EP2009/057741

(51) Int. Cl.
*F28F 9/02* (2006.01)
*F28F 9/00* (2006.01)
(Continued)

(52) U.S. Cl.
CPC ..... *F28F 9/001* (2013.01); *F28D 7/1684* (2013.01); *F28F 9/0219* (2013.01); *F28F 9/0226* (2013.01); *F28D 21/0003* (2013.01)

(58) Field of Classification Search
CPC ..... F28F 9/001; F28F 9/0219; F28F 9/0226; F28D 7/163; F28D 9/0006; F28D 7/1684
(Continued)

(56) References Cited

U.S. PATENT DOCUMENTS 3,173,481 A * 3/1965 Barkley ..... 165/160
6,105,668 A * 8/2000 Schwarz et al. ..... 165/166
(Continued)

FOREIGN PATENT DOCUMENTS

DE 19902504 A1 8/2000
DE 19927607 A1 12/2000
(Continued)

OTHER PUBLICATIONS

English language abstract for DE 19902504 extracted from the espacenet.com database on Jul. 7, 2011, 6 pages.
(Continued)

*Primary Examiner* — Tho V Duong
(74) *Attorney, Agent, or Firm* — Howard & Howard Attorneys PLLC

(57) ABSTRACT

The heat exchanger (1) of the invention has exchange elements (2, 3') and a casing (4) for accommodating the exchange elements (2, 3'). The casing (4) is formed by a plurality of walls connected together. The exchanger (1) is characterized in that the casing (4) has two L-shaped walls. The casing (4) is easier to manufacture and store.

1 Claim, 5 Drawing Sheets

(51) Int. Cl.
*F28D 7/16* (2006.01)
*F28D 21/00* (2006.01)

(58) Field of Classification Search
USPC ..... 165/157, 158, 73, 74, 75, 173, 174, 175
See application file for complete search history.

(56) References Cited

U.S. PATENT DOCUMENTS

| | | | | |
|---|---|---|---|---|
| 6,250,381 | B1 * | 6/2001 | Nishishita ..... F28D 1/05366 165/140 | |
| 6,595,274 | B2 * | 7/2003 | Hayashi et al. ..... | 165/158 |
| 7,077,190 | B2 * | 7/2006 | Hayashi et al. ..... | 165/159 |
| 2003/0010479 | A1 | 1/2003 | Hayashi et al. | |
| 2003/0196785 | A1 | 10/2003 | Knecht et al. | |
| 2005/0189097 | A1 | 9/2005 | Fowser et al. | |
| 2006/0048759 | A1 | 3/2006 | Hendrix et al. | |
| 2006/0048921 | A1 | 3/2006 | Usui et al. | |
| 2006/0219394 | A1 | 10/2006 | Martin et al. | |
| 2006/0278377 | A1 | 12/2006 | Martins et al. | |
| 2007/0017661 | A1 * | 1/2007 | Geskes et al. ..... | 165/166 |
| 2010/0089548 | A1 | 4/2010 | Braic et al. | |
| 2011/0168365 | A1 | 7/2011 | Garret et al. | |
| 2011/0168366 | A1 | 7/2011 | Garret et al. | |
| 2011/0168370 | A1 | 7/2011 | Garret et al. | |

FOREIGN PATENT DOCUMENTS

| | | | |
|---|---|---|---|
| DE | 102005042908 | A1 | 4/2006 |
| DE | 102005037156 | A1 | 2/2007 |
| EP | 1348924 | A2 | 10/2003 |
| FR | 2786560 | A1 * | 6/2000 |
| FR | 2803907 | A1 * | 7/2001 |
| FR | 2814537 | A1 | 3/2002 |
| FR | 2855605 | A1 | 12/2004 |
| FR | 2856747 | A1 | 12/2004 |
| JP | 09089491 | | 4/1997 |
| JP | 09310996 | | 12/1997 |
| JP | 2000282963 | | 10/2000 |
| JP | 2000304486 | | 11/2000 |
| WO | WO 2004065874 | A1 | 8/2004 |
| WO | WO 2008125309 | A2 | 10/2008 |
| WO | WO2009156363 | A1 | 12/2009 |
| WO | WO2009156365 | A1 | 12/2009 |
| WO | WO2010003807 | A1 | 1/2010 |

OTHER PUBLICATIONS

English language abstract for DE 19927607 extracted from the espacenet.com database on Jul. 5, 2011, 9 pages.
English language abstract and equivalent for DE 102005042908 extracted from the espacenet.com database on Jul. 6, 2011, 23 pages.
English language abstract and equivalency for EP 1348924 extracted from the espacenet.com database on Jul. 5, 2011, 11 pages.
English language abstract for FR 2814537 extracted from the espacenet.com database on Jul. 7, 2011, 25 pages.
English language abstract for FR 2855605 extracted from the espacenet.com database on Jul. 6, 2011, 19 pages.
No English language abstract available for FR 2856747. However, see English language equivalency extracted from the espacenet.com database on Jul. 5, 2011, 31 pages.
English language translation for JP 09089491 extracted from the PAJ database on Jul. 6, 2011, 21 pages.
English language translation for JP 2000282963 extracted from the PAJ database on Jul. 6, 2011, 18 pages.
English language translation for JP 2000304486 extracted from the PAJ database on Jul. 5, 2011, 25 pages.
English language abstract and equivalent for WO 2004065874 extracted from the espacenet.com database on Jul. 7, 2011, 35 pages.
English language abstract and equivalent for WO 2008125309 extracted from the espacenet.com database on Jul. 6, 201, 50 pages.
Traite de Cooperation en Matiere De Brevets International Search Report for Application No. PCT/EP2009/057739 dated Oct. 23, 2009, 6 pages.
Traite de Cooperation en Matiere De Brevets International Search Report for Application No. PCT/EP2009/057740 dated Sep. 18, 2009, 4 pages.
Traite De Cooperation en Matiere De Brevets International Search Report for Application No. PCT/EP2009/057741, dated Sep. 9, 2009, 3 pages.
Traite De Cooperation en Matiere De Brevets International Search Report for Application No. PCT/EP2009/057742 dated Sep. 18, 2009 4 pages.
English language translation for JP 09310996 extracted from the PAJ database on Jul. 6, 2011, 22 pages.

* cited by examiner

Fig. 1
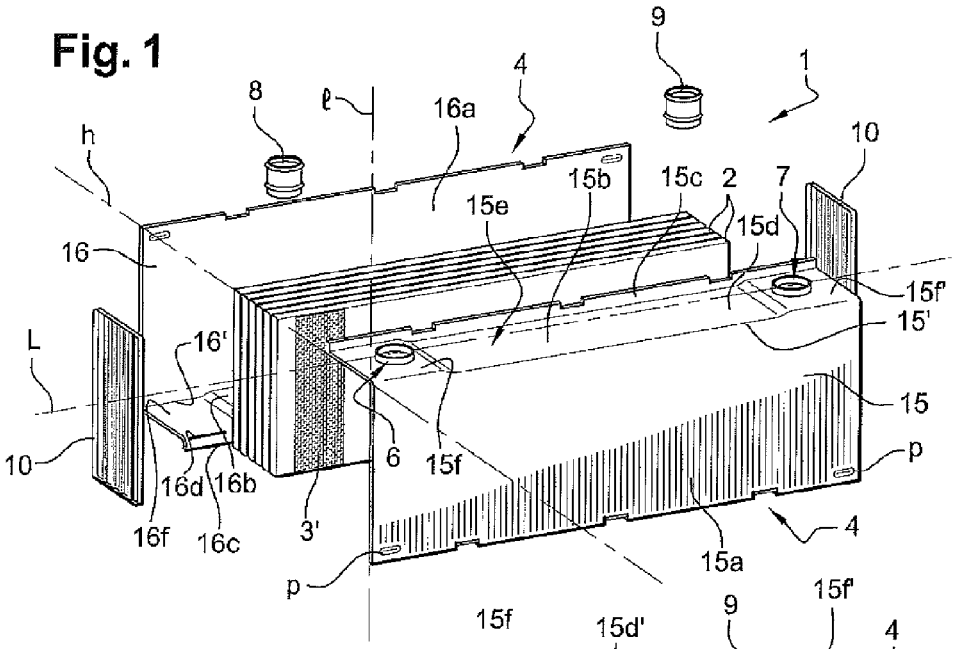
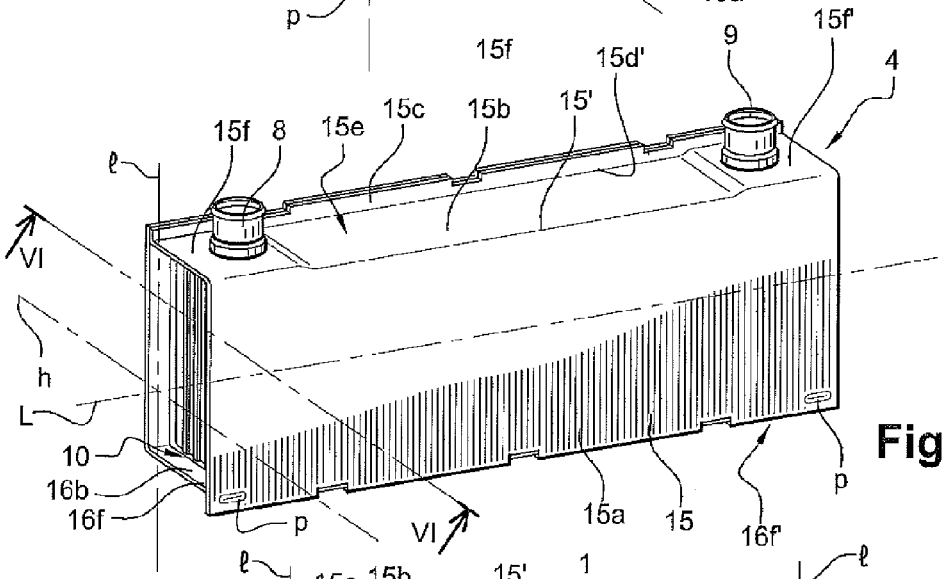
Fig. 2
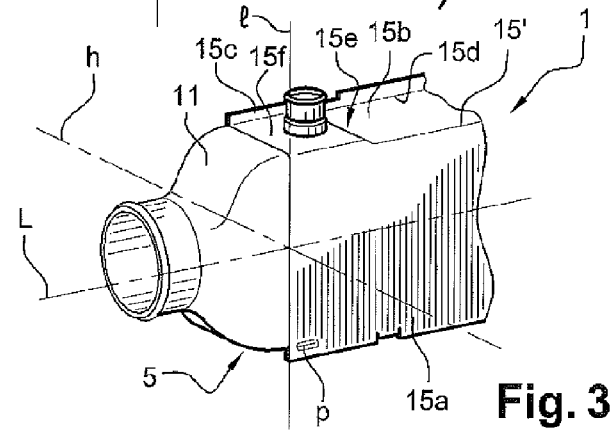
Fig. 3
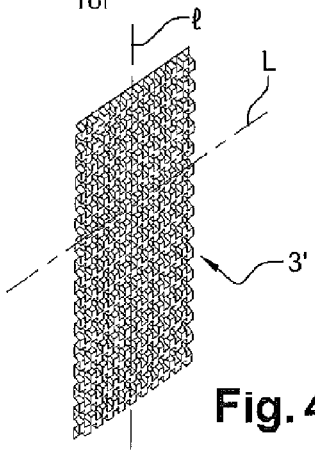
Fig. 4

HEAT EXCHANGER AND CASING FOR THE EXCHANGER

RELATED APPLICATIONS

This application claims priority to and all the advantages of International Patent Application No. PCT/EP2009/057741, filed on Jun. 22, 2009, which claims priority to French Patent Application No. FR 08/03600, filed on Jun. 26, 2008.

The invention relates to a heat exchanger.

A heat exchanger, for example used in the car industry and more particularly in an internal combustion engine of a motor vehicle, comprises heat exchange and fluid flow elements, in which fluids which exchange heat with one another flow. The heat exchange elements can for example comprise tubes, plates, fins, flow-disturbing elements, etc. Numerous structural configurations are conceivable. Exchangers comprising a bundle of tubes arranged parallel to one another on one or more parallel rows are known, these tubes being designed to transport a first fluid, while a second fluid flows between the tubes and exchanges heat with the first fluid. Numerous combinations of fluids are conceivable, be they liquids or gases.

An exchanger having a casing for accommodating exchange elements is in particular known. The casing has a plurality of walls forming the volume in which the exchange elements are accommodated. It is generally open at its two ends in order to be connected there to fluid distribution tanks: namely an inlet distribution tank and an outlet distribution tank. The first fluid flows through the exchange elements from the inlet distribution tank to the outlet distribution tank. Moreover, two orifices are generally provided on the walls of the casing; these orifices are designed to be connected to flow pipes for the second fluid, namely an inlet pipe and an outlet pipe. These pipes open into the volume of the casing and enable the second fluid to flow around the exchange and flow elements for the first fluid.

A casing having a first component with a U-shaped section, which surrounds the exchange elements, and a second component, in the form of a planar wall, which closes the casing on the open side of the U-shaped section of the first component, is known. The orifices generally pierce through one or more walls of the U-shaped component.

The manufacture of casings of this kind is not optimal; two separate components have to be manufactured and at least one of the two has to be pierced. Their storage has not been optimized either.

It is for these reasons that the invention aims to provide an exchanger, the casing of which is simple to manufacture and easy to store.

To this end, the invention relates to a heat exchanger having exchange elements and a casing, for accommodating the exchange elements, formed by a plurality of walls connected together, characterized in that the casing has two L-shaped walls.

By virtue of the invention, the casing is formed from two L-shaped walls, which can be formed with the same tools; moreover, two L-shaped walls can be nested: the storage of the walls intended to form casings is thus made easier. Furthermore, it is simpler to position the exchange elements in two L-shaped walls than to slide them in a U-shaped wall.

According to one embodiment, the two walls have the same external form.

The manufacture and storage of the casing are thus even easier.

According to one embodiment, each wall has two flaps which are perpendicular to one another, one flap of each wall having a turned-up edge for securing to a flap of the other wall.

According to one embodiment, with each wall having two flaps, one of the flaps has an indentation which is designed to come into contact with flow tubes, which are assembled in parallel, for a first fluid and thus to form flow channels for a second fluid between said tubes.

The production of such an indentation is made easier by the L shape of the walls, thereby enabling easy access on either side of each flap in order to make the indentation therein (this not being the case with a U-shaped wall).

According to one embodiment, with the flap having the indentation also having at least one orifice for connecting to a flow circuit for the second fluid, said orifice is formed on a portion of the flap which is separate from the indentation in order to enable better distribution of the second fluid in its flow channels.

According to one embodiment, each wall has at least one sealing portion designed to fill a clearance in the area where it is secured to the other wall. More particularly, this is a clearance between these walls and a header plate for holding the exchange elements in position.

According to one embodiment, the walls are brazed together and, preferably, the exchange elements are brazed to the walls.

According to one embodiment, the walls have means for holding the exchange elements during the brazing process.

The invention also relates to a casing for accommodating exchange elements of a heat exchanger, said casing being formed by a plurality of walls connected together, characterized in that it has two L-shaped walls.

This casing has the advantages of the casing of the exchanger presented hereinabove.

The casing may have the features of the casing of the exchanger presented hereinabove.

According to one particular embodiment of the exchanger, with the exchange elements forming flow means for fluid and opening into a fluid collection box through the orifices in a header plate for holding the exchange elements, the orifices are provided with stiffening means.

By virtue of the stiffening means, the header plate has good mechanical strength and the dimensions of the orifices are ensured.

It is noted that language has been slightly misused in the presentation of this particular embodiment of the invention when it is stated that the orifices are provided with stiffening means. This is because an orifice is an opening bordered by a wall. It should thus be understood that it is the header plate that has stiffening means, through which the orifices are provided; in fact they are thus wall stiffening means forming (or bordering) the orifices.

According to one embodiment, the exchange elements have tubes.

According to one embodiment, the tubes abut the header plate, in line with the orifices.

According to one embodiment, the stiffening means comprise at least one strap, extending in an orifice, which also forms an abutment for a tube connected to the orifice.

According to one embodiment, each orifice has at least one stiffening strap for the abutment of a tube connected to the orifice.

According to one embodiment, said stiffening and abutment strap forms an integral part of the header plate and, in particular, is in one piece with the header plate.

According to one embodiment, the stiffening means comprise at least one neck bordering an orifice.

According to one embodiment, each orifice is bordered by at least one neck, which also fulfills a function of retaining one end of a tube connected to the orifice.

According to one embodiment, the end of the tube is brazed to the neck.

According to one embodiment, with the header being formed from a plate, preferably a metal plate, the neck is formed by folding the plate.

According to one embodiment, at least one stiffening strap for the abutment of a tube extends between opposing necks on either side of the orifice.

According to one embodiment, the orifices have a first dimension greater than 50 mm and are separated from one another, in a second dimension substantially perpendicular to the first dimension, by a distance less than or equal to 3 mm.

According to another particular embodiment of the heat exchanger, with the exchange elements forming fluid flow means, being held by a header plate and opening into a fluid collection box, the fluid collection box is held directly by the casing.

By virtue of this other particular embodiment of the invention, with the box being held directly by the casing, it is no longer necessary for the header plate to comprise box holding means. Thus, the external space requirement (the "overall" volume) of the exchanger is limited to the external space requirement of the casing; the compactness of the exchanger is thus improved.

According to one embodiment, the header plate is also held by the casing.

According to one embodiment, the collection box and the casing are welded or brazed.

According to one embodiment, the box has an end portion having a form complementary to the form of one end of the casing to which it is welded or brazed, in order to ensure continuity of the external surface of the exchanger.

According to one embodiment, the collection box and the casing are crimped.

According to one embodiment, the casing has at least one tab for crimping the collection box, said tab being designed to engage with a surface of the collection box in order to hold it.

According to one embodiment, with the header plate also being held by the casing, the casing has at least one abutment and the collection box and the header plate are held between the crimping tab and the abutment.

According to one embodiment, the exchanger has sealing means between the fluid collection box and the header plate, for example a seal or a brazing between the collection box and the header plate.

According to a particular feature of the casing of the invention, with the exchange elements being intended to be held by a header plate and to open into a fluid collection box, the casing has means designed to directly hold the fluid collection box.

According to one embodiment, the casing has at least one crimping tab.

According to one embodiment, the casing has an abutment designed to hold the collection box and the header plate between the crimping tab and the abutment.

The invention applies to any heat exchanger. It applies particularly well to a heat exchanger for cooling a gas with water, and even more particularly to a cooler for what are known as "recirculated" exhaust gases of a motor vehicle internal combustion engine or to a charge-air cooler of such an engine.

The invention will be better understood with the aid of the following description of the preferred embodiment of the exchanger of the invention, with reference to the appended plates of drawings, in which:

FIG. 1 shows an exploded perspective view of a first embodiment of the exchanger of the invention;

FIG. 2 shows a perspective view of the exchanger in FIG. 1 with its various elements fitted together;

FIG. 3 shows a perspective view of one end of the exchanger in FIG. 2 with a fluid distribution box secured to its casing;

FIG. 4 shows a perspective view of a portion of the element disturbing the flow of water in the exchanger in FIG. 2;

Figure 5:
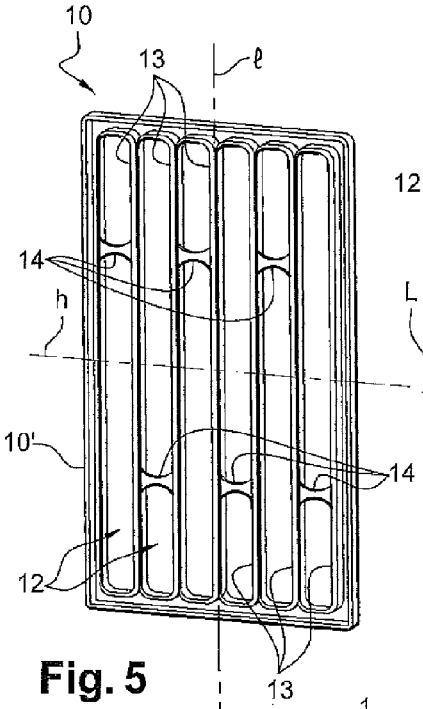
FIG. 5 shows a perspective view of one of the header plates of the exchanger in FIG. 2.
Figure 16:
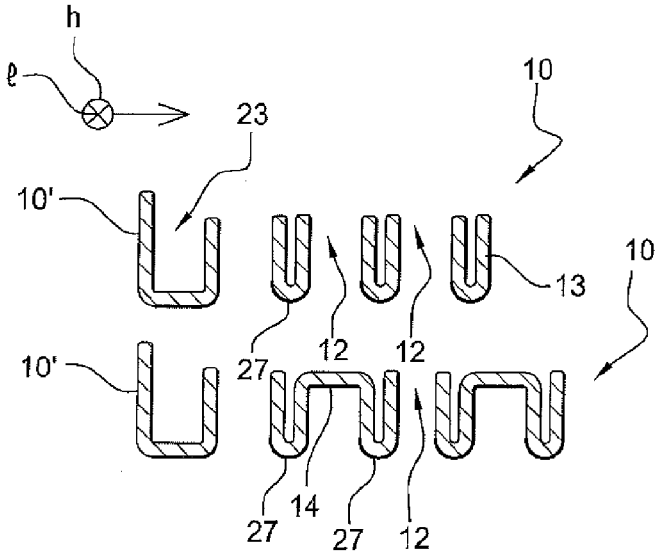
Figure 17:
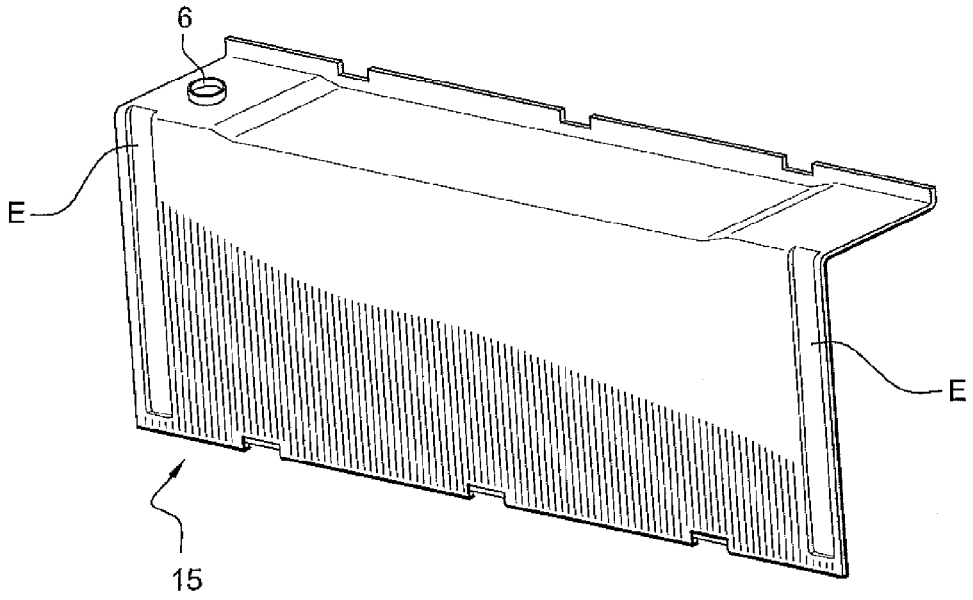

FIG. 16 schematically shows two separate section views of the header in FIG. 5: one in a plane not cutting through a strap (top drawing) and the other in a plane cutting through a strap (bottom drawing); and FIG. 17 is a perspective view of the wall of a casing according to a particular embodiment.

With reference to the figures, and more particularly to FIG. 1, a heat exchanger 1 according to a first embodiment has heat exchange elements 2, 2', 3, 3', a casing 4 for accommodating these elements 2, 2', 3, 3', an air inlet distribution tank 5 and an air outlet distribution tank (not shown). The casing 4 has orifices 6, 7 for connecting to water flow pipes 8, 9, in this case an inlet pipe 9 and an outlet pipe 8, which are connected to a water circuit in which the exchanger 1 is fitted. In the embodiment described, the various elements of the exchanger 1 are brazed together; such exchangers having their elements brazed are well known to a person skilled in the art.

The exchanger 1 described is what is known as an "air-water" exchanger, that is to say an exchanger in which the fluids which exchange heat are air and water. It is, for example, a cooler for cooling with water what are known as the "recirculated" exhaust gases of a motor vehicle internal combustion engine or else a charge-air cooler of such an engine; the water is preferably the water of what is known as the "low temperature" cooling circuit of said engine; it is typically glycolated water.

With reference to FIG. 2, the exchanger 1 has a parallel-epipedal overall form. By convention, and in order to simplify its description, the direction L is defined as the length of the exchanger 1, which is its greatest dimension, and in the direction of which the fluids flow, the direction 1 as the width of the exchanger 1 and the direction h as its height (or thickness). Subsequently, the direction of these dimensions will be merged with their value; in other words, L, l or h will respectively designate either the length, the width and the height of the exchanger 1 or the direction of the length, the direction of the width and the direction of the height of the exchanger 1. Moreover, the notions of external (or outside) and internal (or inside) which could be used in the description refer to relative positions of elements with respect to the outside or inside of the exchanger 1.

The exchange elements have flow tubes 2 for air, in which fins 2' for disturbing this flow of air are fitted. Between each other, the tubes 2 define flow channels 3 for water, in which disturbing elements 3' for this flow of water are fitted.

More precisely, the air flow tubes 2 are in a flattened form; their long dimension (which is the general direction of the flow of air within them) is parallel to the direction of the length L of the exchanger 1 and their cross section with respect to this length L is rectangular; the rectangle forming the section of each tube 2 has a dimension parallel to the width 1 of the exchanger 1 and a dimension parallel to the height h of the exchanger 1. Each tube 2 has a length approximately equal to the length L of the exchanger 1 and a width approximately equal to the width 1 of the exchanger 1; its dimension parallel to the height h of the exchanger 1 is less than the height of the exchanger 1 since the tubes 2 are stacked in this dimension; this dimension is in this case relatively small, thereby giving the tubes 2 their flattened form; it is in fact their thickness. By way of example, the thickness of the tubes 2 can be about 7 or 8 mm for each tube 2, the width 1 of the tubes 2 being about 100 mm. Moreover, the inter-tube spaces (that is to say the water flow channels 3) can for example have a dimension (parallel to the height h of the exchanger 1) less than 3 mm, for example approximately 2 mm.

Figure 7:
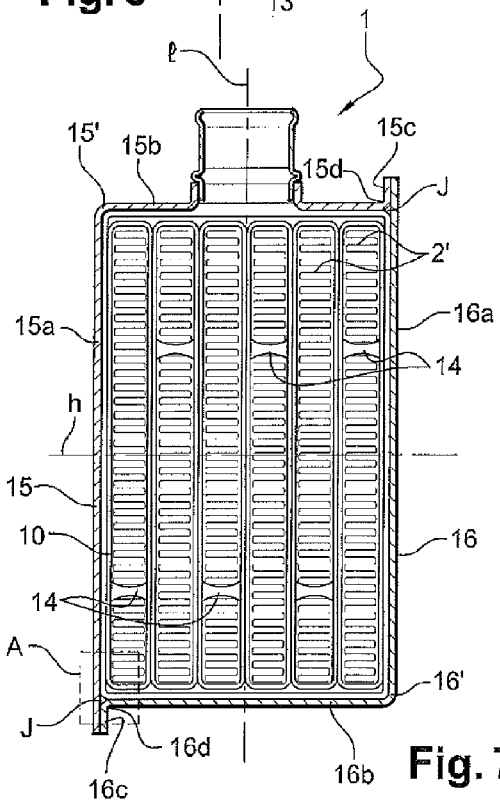
FIG. 7 is a view of the right-hand end, as seen along the axis in its lengthwise direction, of the exchanger in FIG. 2.

With reference to FIG. 7, the fins 2' are fitted in the internal volume of the tubes 2. The function of these fins 2' is to disturb the flow of air in the tubes 2 in order to facilitate heat exchanges between the air and the water through the walls of the tubes 2. These fins 2' are well known to a person skilled in the art and it is not necessary to describe them in detail; they have in this case an undulating form and their section has, as seen from the end along the axis of the length L of the exchanger 1, a serpentine form between the walls of each tube 2.

The tubes 2 are assembled parallel to one another, the tubes 2 as a whole forming a stack in the direction of the height h of the exchanger 1 (this is also known as a tube bundle); the dimension of the bundle 1 parallel to the height h of the exchanger 1 is substantially equal to the height h of the exchanger 1. Thus, the tubes 2 are assembled together, parallel to one another, and enable air to flow within them, generally in the direction of the length L of the exchanger. The exchanger 1 described here has a bundle of six tubes 2; of course, it could have a lower or higher number thereof; it is noted here that, in some cases, the height h of the exchanger 1 can be greater than its width 1, if the number of tubes 2 is high enough.

Figure 6:
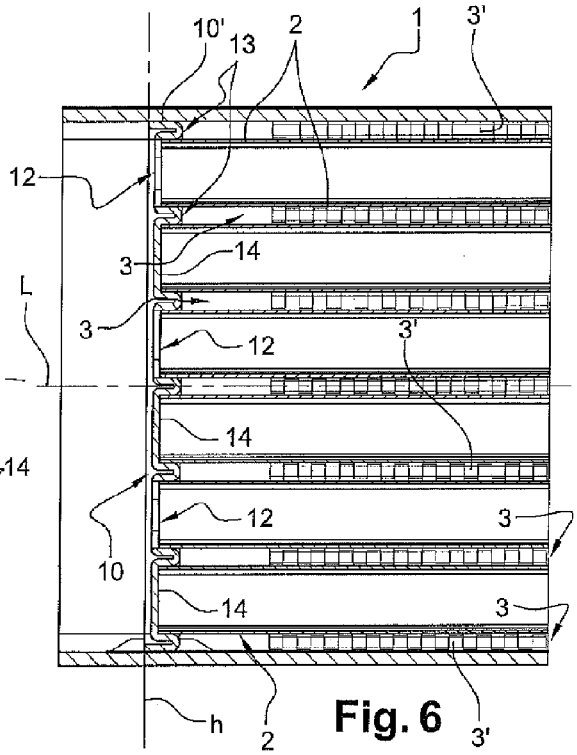
FIG. 6 shows a section view of one end of the exchanger in FIG. 2, along the plane VI-VI in FIG. 2.

The tubes 2 form between one another water flow channels 3, in which disturbing elements 3' for the flow of water between the tubes 2 are secured, in this case by brazing. A portion of a disturbing element 3' is shown in FIG. 4. In FIG. 1, again only a portion of a disturbing element 3' has been shown; specifically, the disturbing elements 3' are in the form of plates which extend approximately over the entire lateral surface of the tubes 2 (the lateral surface means the surface of the tubes 2 defined by the dimensions parallel to the length L and to the width 1 of the exchanger 1), except for close to the ends (in the direction of the length L of the exchanger 1) of the tubes 2, as will be seen hereinbelow. Furthermore, each disturbing element 3' fills, in the direction parallel to the height h of the exchanger 1, the entire space of the water flow channel 3 in which it is fitted, since it is brazed on each side to the surfaces of the tubes 2 defining said channel 3. It is noted here that disturbing elements 3' are fitted between all the tubes 2 but also between the end tubes 2 and the walls of the casing 4, as can be seen in FIG. 6.

The disturbing elements 3' have a form creating turbulence in the flow of water passing across them. In this case, the disturbing elements 3' are in the form of an undulating wall, these undulations being at right angles to and in the two dimensions (L, l) of the plate forming the disturbing element 3'. In other words, the disturbing elements 3' have, both in the direction parallel to the width 1 of the exchanger 1 and in the direction parallel to the length L of the exchanger 1, crenelated wall elements, the rows of elements being offset with respect to one another. Recesses are furthermore provided periodically in the wall elements; the motifs defining the form of the disturbing elements 3' are periodic. It is not necessary to describe more precisely the structure of the disturbing elements 3', inasmuch as they are well known to a person skilled in the art and their structure can clearly be seen in FIG. 4. Water flows between the air flow tubes 2 and its flow is disturbed by the disturbing elements 3', thereby facilitating heat exchanges with the air through the walls of the tubes 2.

As mentioned hereinabove, the exchanger 1 has, at each of its ends (in the dimension of its length L), an air distribution tank. On the left-hand side (in the figures), this is an air inlet distribution tank 5 and, on the right-hand side, this is an air outlet distribution tank (not shown). The ends of the air flow tubes 2 are connected to the air distribution tanks 5, the internal volume of the tubes 2 thus being in fluid connection with the internal volume of the distribution tanks 5; in other words, the tubes 2 open into the tanks 5. The distribution tanks 5 are connected to pipes of an air circuit in which the exchanger 1 is fitted. Air is introduced into the tubes 2 through the inlet distribution tank 5 and is collected at the outlet of the tubes 2 by the outlet distribution tank.

The structure of the inlet distribution tank 5 will now be described. The position and form of its elements are described, for the sake of simplifying the description, in a fitted position of the tank 5 on the exchanger 1. The outlet distribution tank (not shown) is in this case identical to the inlet tank 5 and fitted symmetrically; of course, in another embodiment, they can be different.

The inlet distribution tank 5 has a header plate 10, the function of which is to hold the tubes 2 in position, to guide the flow of air between the internal volume of the distribution tank 5 and the tubes 2 and to block the flow of water into the internal volume of the tank 5, while preventing the flows of air and water from meeting; the header plate 10 is generally known by a person skilled in the art as a header 10. It is noted that the header 10 of the outlet distribution tank is in this case identical to the header 10 of the inlet distribution tank and is designated in the figures with the same reference numeral, 10. The tank 5 further has an air collection box 11, or cover 11, or header box 11, forming with the header 10 the volume of the tank 5. More precisely, with reference to FIG. 10, the volume of the tank 5 is in this case formed by the header box 11, the header 10 and a portion of the casing 4. Specifically, in the embodiment shown in FIGS. 1 to 10, the header 10 is secured to the casing 4 at a distance d from the end of the header box 11, which is itself secured to the casing 4, as will be seen hereinbelow; as a result, the volume of the tank 5 is formed in part by the portion of the casing 4 separating the header 10 from the header box 11.

With reference to FIG. 5, the header 10 is in the form of a plate fitted transversely to the length L of the exchanger 1 in order to accommodate the ends of the tubes 2. The header 10 is pierced by a plurality of orifices 12, each orifice 12 being connected to a tube 2. Each orifice 12 has a form corresponding to the section of a tube 2. Each orifice 12 is bordered by stiffening walls 13 or stiffening necks 13 or stiffening rims 13 of the header 10. Such necks 13 ensure that the dimensions of the orifices 12 are constant and defined; specifically, the necks 13 form stiffened walls defining (bordering) the orifices 12, that is to say that they form means for stiffening these orifices 12.

The necks 13 furthermore fulfill a function of retaining the end of the tubes 2 connected to them. These necks 13 generally extend perpendicularly to the overall plane of the plate forming the header 10, and thus parallel to the direction of the length L of the exchanger 1, the end 27 protruding from these necks 13 being directed toward the inside of the exchanger 1; in other words, the stiffening necks 13 retaining the tubes 2 extend, from the header 10, around the tubes 2, the ends of which they surround. In FIG. 5, the header 10 can be seen from behind and its necks 13 extend forward. The function of the necks 13 is to hold the tubes 2 in position: to this end, the ends of the tubes 2 are slid into these necks 13, forming a slideway in order to surround them; each neck 13 forms a contact surface with the surface of the end of the tube 2 connected to it, enabling them to be brazed together. The tubes 2, thus brazed to the necks 13 bordering the orifices 12 of the header 10, are secured in position.

Each orifice 12 of the header 10 is furthermore provided with a stiffening tongue 14 or stiffening strap 14 or stiffening line 14. The straps 14 extend at the base of the stiffening necks 13 for retaining the tubes 2, that is to say on the side opposite their protruding end 27; thus, the straps 14 extend on the outside of the exchanger 1. In the embodiment described, the straps 14 are formed in the orifices 12 of the header 10 over approximately a quarter of its dimension parallel to the width 1 of the exchanger 1, in alternation, from one orifice 12 to another, on one side and on the other of the header 10 in this dimension. By virtue of the alternation of the straps 14 on either side of the header 10, the stiffening function they fulfill is distributed and homogeneous over the header 10.

A stiffening function of the straps 14 is to ensure the spacing of the necks 13 bordering the orifices 12 in order to ensure the dimensions of the orifices 12, that is to say in order to ensure that all the orifices 12 constantly have the same dimension in the direction parallel to the height h of the exchanger 1, despite the high slenderness ratio of the necks 13. The expression "slenderness ratio" is understood to mean the ratio of the long dimension of the necks 13 (the dimension parallel to the width 1 of the exchanger 1) to one of the short dimensions of the necks 13 (either the dimension parallel to the thickness h of the exchanger 1 or the dimension parallel to the length L of the exchanger 1).

Thus, the necks 13 and the straps 14 complement one another in order to fulfill a stiffening function for the header 10 and thus to ensure the dimensions of its orifices 12 and the stability of the latter. These elements 13, 14 are combined all the more since the straps 14 are secured to the necks 13, because they are in one piece with them and extend from their base.

Another function of the straps 14 is to form an abutment for the ends of the tubes 2 slid between the necks 13 (it thus being an axial abutment on the axis of the length L of the exchanger 1). Thus, the tubes 2 abut the header 10 in line with the orifices 12, which means that they do not pass through the orifices 12 but are stopped at (in line with) the orifices 12 by the straps 14. FIG. 6 shows a section view of the ends of the tubes 2 slid into the necks 13, in abutment with the straps 14 and brazed to the necks 13; this section is along the plane VI-VI in FIG. 2, this being a plane cutting through an area of the header 10 at the straps 14.

By virtue of the straps 14, each tube 2 is positioned perfectly in line with the orifice 12 to which it is connected. Since the dimensions of the orifices 12 are fixed in a stable manner by the straps 14, there are no significant fluctuations, along the periphery of the end of a tube 2, in the spacing between the external surface of this end and the internal surface of the necks 13 surrounding it; said surfaces (of the necks 13 and of the ends of the tubes 2) can thus be brazed together with brazing of quality, since it is regular. Moreover, it is possible also to braze the tubes 2, by their end, to the straps 14; the latter thus increase the available brazing surface area and thus the mechanical strength of the exchanger 1.

Of course, other distributions or arrangements of the straps 14 are conceivable. For example, the straps 14 can all extend in the middle of the orifices 12 of the header 10; in this case they are all aligned. Also for example, each orifice 12 can have a plurality of stiffening straps 14. Furthermore, other stiffening means, which also fulfill an abutment function for the tubes 2, can be provided. In any case, it is understood that the stiffening means, and thus in this case the straps 14, do form stiffening means for an orifice 12 and not means for separating two orifices; each orifice 12, with its stiffening means 14, is connected to a single tube 2; stiffening means (straps 14) therefore must not be confused with means for separating two orifices 12. Moreover, if the header 10 were to comprise a plurality of orifices aligned in its direction parallel to the width of the exchanger 1, such orifices would be separated by means separate from the straps 14; in particular, and preferably, a part of the stiffening neck for retaining the tubes would extend between the successive orifices in this direction 1.

FIGS. 6 and 7 show the manner in which the header 10 is positioned with respect to the tubes 2 and thus the manner in which it fulfills its function, not just of holding the tubes 2 in position, but also of guiding air between the volume of the header box 11 and the tubes 2 and of blocking the flow of water toward the header box 11. In the embodiments presented, the header 10 is contained in the casing 4; in other words, the casing 4 is a casing 4 for accommodating the exchange elements 2, 2', 3, 3' and the headers 10.

The tubes 2 abut the header 10 in line with the orifices 12, with their end walls brazed to the necks 13; the ends of the tubes 2 are thus separated from one another by these necks 13; the separation spaces between the successive tubes 2 define the flow channels 3 for the flow of water, the disturbing elements 3' being fitted in said flow channels 3. Since the necks 13 are brazed to the ends of the tubes 2 and transversely fill (with respect to the direction of the length L of the exchanger 1) the entire space between one another, these necks 13 prevent water from flowing into the volume of the header box 11; moreover, these necks 13 also prevent the water from flowing into the tubes 2.

The structure of the header 10 of the exchanger will also now be described, for better understanding, with reference to FIG. 16. This figure shows sectional representations of the header 10, in a plane transverse to that of the width 1 of the exchanger 1 when the header 10 is fitted therein. In other words, it is a section in a plane cutting through the orifices 12 of the header 10 transversely with respect to their long dimension.

The header 10 is formed from a planar metal plate. This plate is stamped to form the necks 13 and punched to form the orifices 12 bordered by the necks 13. The necks 13 are thus in the form of double walls parallel to the long dimension 1 of the header 10, these double walls being connected by their free end 27. The straps 14 are formed during the punching operation by the areas corresponding to the straps 14 not being punched. The straps 14 are thus an integral part of the header 10 and, more precisely, are in one piece with this header 10 and in particular its necks 13.

The peripheral edge of the header 10 is turned up to form the peripheral groove 23 of the header 10 (this groove 23 is thus formed between the peripheral edge and the external walls of the necks 13). In the first embodiment of the exchanger 1 shown with reference to FIGS. 1 to 10, the groove 23 is not exploited as such but the turning up of the external edge of the header 10 makes it possible to have a surface 10' perpendicular to the plane of the header 10 and able to be brazed to the internal surfaces of the casing 4. In the second embodiment of the exchanger 1 shown with reference to FIGS. 11 to 15, the peripheral groove 23 holds the seal 21.

The folding of the necks 13 about their long axis ensures that the necks 13 do not twist during the formation of the orifices 12 by punching the plate. It is noted, moreover, that, according to an embodiment which is not shown, the folded necks 13 can be the only stiffening means, without it being necessary to provide straps 14.

In each orifice 12, the strap 14 extends between opposing necks 13 on either side of the orifice 12, maintaining and thus ensuring the spacing between these necks 13. Since the straps 14 are an integral part of the header 10, and more particularly since they are in one piece therewith, the stiffness of the assembly is even better.

By virtue of the stiffening means (folded necks 13 and/or straps 14), a header 10 having elongate orifices 12 separated by narrow walls 13 (corresponding to a small inter-tube distance) can be formed; thus, the necks 13 have a high slenderness ratio. It is thus possible to connect the orifices 12 to tubes 2 having a flattened and elongate section. This makes it possible to have a large air-passage section for a small thickness h of the tubes 2 and thus to manufacture an exchanger 1 having a good airflow despite having a small space requirement in the direction of its thickness h; this is particularly advantageous when the space requirement of the engine in which the exchanger 1 is intended to be fitted imposes a limit on the thickness h of the exchanger 1, which must thus be relatively flat.

By way of example, with the plate for forming the header 10 having a thickness of about 1 mm, a header 10 having orifices 12 of around 100 mm by 7 or 8 mm can be formed with an inter-tube space of 2 to 3 mm. The necks 13 can have a space requirement (dimension parallel to the direction of the length L of the exchanger 1) of approximately 4 mm; thus, by subtracting the thickness of the straps 14 (1 mm), the necks 13 have a useful surface for retaining the end of the tubes 2 and for brazing therewith of around 3 mm.

The exchange elements, namely the tubes 2 with their fins 2' and the channels 3 with their disturbing elements 3', are contained in an accommodating casing 4. The casing 4 has a first wall 15 and a second wall 16, these walls 15, 16 being L-shaped; in other words, each wall 15, 16 has a cross section (with respect to the direction of the length L of the exchanger 1) in the form of an L. Each wall 15, 16 is L-shaped by folding about an edge 15', 16' in order to form two flaps (15*a*, 15*b*), (16*a*, 16*b*) perpendicular to one another.

More precisely, each wall 15, 16 has in this case a large flap 15*a*, 16*a* and a small flap 15*b*, 16*b*. The large flap 15*a*, 16*a* is in the form of a rectangular plate having dimensions approximately equal to the length L of the exchanger 1 and to its width 1, whereas the small flap 15*b*, 16*b* is in the form of a rectangular plate having dimensions approximately equal to the length L of the exchanger 1 and to its height h. The notions of large and small flaps are introduced here to enable each of the flaps (15*a*, 15*b*), (16*a*, 16*b*) of each wall 15, 16 to have a separate designation; it happens to be that, in the embodiment shown, on account of the relative dimensions of the height h and the width 1 of the exchanger 1, one flap (15*a*, 15*b*) is larger than the other (16*a*, 16*b*), but it goes without saying that if the proportions between these dimensions were to be reversed, the notions of large and small flaps would be reversed; in brief, it should be understood that these notions of large and small do not constrain or limit the exchanger 1, but that it is simpler to designate them in this way because this is the case here.

The water inlet pipe 9 and outlet pipe 8 in the exchanger 1 are connected here to a single face of the exchanger 1. Thus, the orifices 6, 7 for connecting to these pipes 8, 9 are pierced through a single flap of one of the two walls 15, 16, in this case through the small flap 15*b* of the first wall 15.

The two walls 15, 16 are identical except for the orifices 6, 7 pierced into the small flap 15*b* of the first wall 15; in particular, their external forms are thus identical. As a result, it is simpler to manufacture them, since this can be unified, while it is easier to store them, since the external form of the walls 15, 16 makes them nestable with one another. Thus, it is possible for a single tool to manufacture all the L-shaped walls, only half of which are subsequently pierced with orifices. The walls can then be stored easily and in an optimal manner (as far as their space requirement is concerned), since they are simply nested and stacked on one another.

In order to form the casing 4 in its final form, the walls 15, 16 are secured to one another around the exchange elements 2, 2', 3, 3' and the headers 10; in this case, they are brazed. To this end, each wall 15, 16 has, at the free end of its small flap 15*b*, 16*b*, a turned-up edge 15*c*, 16*c*, which is an edge 15*c*, 16*c* for securing to the large flap 16*a*, 15*a* of the other wall 16, 15. This turned-up edge 15*c*, 16*c* extends perpendicularly to the small flap 15*b*, 16*b* from a folding edge 15*d*, 16*d* by which it is connected thereto; this folding edge 15*d*, 16*d* is parallel to the folding edge 15', 16' between the large flap and the small flap (15*a*, 15*b*), (16*a*, 16*b*).

The orientation of the turned-up edges 15*c* and 16*c*, here, perpendicularly to the small sides 15*b* and 16*b* and toward the outside allows a good joint between the casing 4 and the headers 10. The expression "toward the outside" is understood to mean that the turned-up edge or edges 15*c*, 16*c* are not, in this case, in contact with the tubes 2. In the embodiment illustrated here, only the folding edge or edges is or are in contact with the exchange elements. Also in other words, in this case, the turned-up edge 15*c* or 16*c* extends outside the volume defined by the exchange elements 2, 2', 3, 3' and/or the header 10.

The L-shaped walls 15, 16 are positioned around the heat exchange elements 2, 2', 3, 3' and the headers 10 in reversed positions, in other words head to tail; in this position, the turned-up edge 15*c*, 16*c* of the small flap 15*b*, 16*b* of each wall 15, 16 presses against the free end of the large flap 16*a*, 15*a* of the other wall 16, 15. The different elements of the walls 15, 16 are configured such that the free end—parallel to the folding edge 15*d*, 16*d*—of each turned-up edge 15*c*, 16*c* extends in line with the free end of the large flap 16*a*, 15*a* against which it is pressed. In this position, the walls 15, 16 of the casing 4 are brazed together, by brazing the surfaces of their flaps (15*a*, 15*b*), (16*a*, 16*b*) in contact with one another (turned-up edges 15*c*, 16*c* against ends of the large flaps 16*a*, 15*a*). Once the walls 15, 16 have been secured, the flaps (15*a*, 15*b*), (16*a*, 16*b*) of the L-shaped walls 15, 16 form the four lateral faces of the exchanger 1 (these are known as lateral faces with respect to the direction of its length L).

It is noted here that, in the embodiment described, the header 10 is secured to the casing 4 by brazing. More precisely, the external surface 10' which extends along its periphery is brazed to the internal surface of the flaps (15*a*, 15*b*), (16*a*, 16*b*) of the walls 15, 16.

The L-shape of the walls 15, 16 facilitates the positioning of the casing 4 around the exchange elements 2, 2', 3, 3'. This is because it is complicated to house a bundle of tubes in a U-shaped wall, the dimensions of which are adapted to the external form of the bundle; in particular, the bundle must be held in order for it to remain in position, whereas this bundle must be slid between the walls forming the legs of the U-shaped wall, this being difficult since it is desirable for there not to be too large a clearance between them. On the other hand, it is very simple to position a first wall 15, 16 in contact with two of the faces of the bundle of tubes 2, then to position the second wall 16, 15 and finally to braze them. In particular, in order to position the walls 15, 16 in this way, it is not necessary to hold the tubes 2 and disturbing elements 3' firmly in position, since they position themselves under the action of the second wall 16, 15 when it is positioned. Moreover, there is no clearance problem, since the bundle does not slide between the walls, but rather the walls 15, 16 are pressed against the bundle.

By virtue of the L-shape of the walls 15, 16 of the casing 4, the flaps 15*a*, 16*a* of the walls 15, 16 parallel to the lateral faces of the tubes 2 do not protrude from the volume of the exchanger 1; in other words, the large flaps 15*a*, 16*a* are planar and no element protrudes from them in the direction perpendicular to them. This feature results from the fact that, on account of the L-shape of the walls 15, 16, securing takes place along surfaces parallel to the planes of these large flaps 15*a*, 16*a* (the contact surfaces between the turned-up edges 15*c*, 16*c* of the small flaps 15*b*, 16*b* and the large flaps 15*a*, 16*a*). However, during the brazing of the exchanger 1, the brazing fitting, that is to say the device for implementing this brazing, comprises tools, for example presses, which press against the faces of the casing 4 which are parallel to the lateral faces of the tubes 2 (in this case the large flaps 15*a*, 16*a*), since the surfaces for brazing the tubes 2 to the disturbing elements 3' are parallel thereto and it is therefore advisable to apply forces perpendicular to these surfaces. Since the large flaps 15*a*, 16*a* are planar, it is simpler for the tools to come into contact with them since the tools can be brought into contact with the entire surface of the flaps 15*a*, 16*a* without any space requirement constraints.

The small flap 15*a*, 16*a* of each wall 15, 16 has an indentation 15*e*, 16*e* or dish 15*e*, 16*e* in its central part. This indentation 15*e*, 16*e* is obtained by stamping the wall 15, 16. This stamping 15*e*, 16*e* is designed to come into contact with the edges of the tubes 2 in order to be brazed thereto; more precisely, it is its internal surface which is brazed to the edges of the tubes 2. The expression "edge of the tubes 2" is understood to mean the wall thereof extending in the plane defined by the direction of the length L of the exchanger 1 and the direction of the thickness h (the height h) of the exchanger 1. The function of this brazing is to prevent water flowing outside the water flow channels 3 formed between the tubes 2 and thus to ensure that the water only flows along the surfaces of the lateral walls of the tubes 2 in order to exchange a maximum of heat with the air flowing in the tubes 2. Thus, the brazing of the indentations 15*e*, 16*e* of the casing 4 forces the water to flow between the tubes 2. Moreover, this brazing increases the overall mechanical strength of the exchanger 1.

The formation of such an indentation 15*e*, 16*e* in the walls 15, 16 is facilitated by the L-shape of these walls 15, 16 since this enables easy access, for tools, to the two sides of each flap (15*a*, 15*b*), (16*a*, 16*b*).

Figure 8:
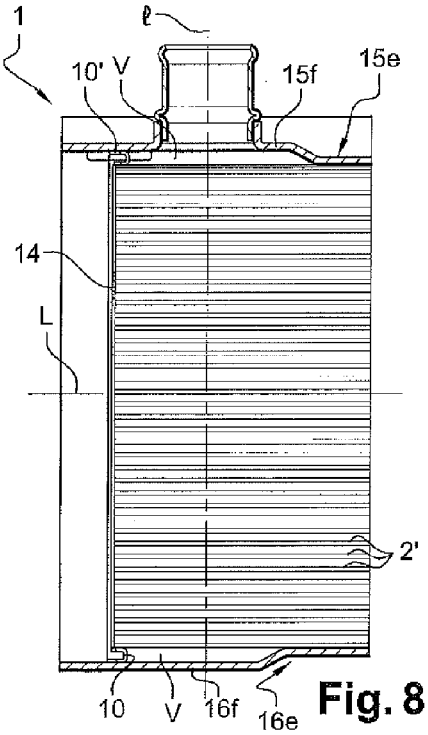
FIG. 8 is a section view, in profile, of one end of the exchanger in FIG. 2.

The internal surfaces of the ends (15*f*, 15*f'*), (16*f*, 16*f'*)—in the direction of the length L of the exchanger 1—of the small flap 15*b*, 16*b* of each wall 15, 16, on either side of the indentation 15*e*, 16*e*, extend at a distance from the edges of the tubes 2. Thus, at their end portions (15*f*, 15*f'*), (16*f*, 16*f'*), the walls 15, 16 form with the edges of the tubes 2 a volume V (same reference for all the volumes in question); such volumes V are formed, at the two ends of the exchanger 1, on either side of the tubes 2. These volumes V are in fluid connection with all the water flow channels 3. The orifices 6, 7 for connecting to the pipes 8, 9 of the water circuit are formed in these end portions (15*f*, 15*f'*), (16*f*, 16*f'*) of the small flaps 15*b*, 16*b* of the walls 15, 16, that is to say in separate portions of the indentations 15*e*, 16*e*; thus, the water arrives in the exchanger 1 or exits therefrom through a volume V connected to all the water flow channels 3. Furthermore, the presence of these volumes V makes it possible, as can be seen in FIG. 8, to form enough space for fitting the headers 10 at each end of the exchanger 1. It is noted incidentally here that FIG. 8 is a section view formed inside a tube 2; elements parallel to one another can be seen therein: these are the walls of the fins 2' for disturbing the flow of air.

By virtue of the arrangement of the walls 15, 16 and their indentations 15*e*, 16*e* with respect to the tubes 2, the exchanger 1 is supplied with water through the orifice 7 connected to the water inlet pipe 9 and the water flows into the volume V formed close to this orifice 7, thereby enabling it to be distributed in all the water flow channels 3. The water flows in these channels 3 and is prevented from flowing beyond the edges of the tubes 2 since the latter are brazed to the internal surfaces of the indentations 15*e*, 16*e* of the small flaps 15*b*, 16*b* of the walls 15, 16; in other words, the water is confined in the channels 3 formed between the tubes 2, thereby maximizing heat exchanges between the water and the air which flows in the tubes 2. The water is collected at the outlet in the volume V formed close to the orifice 6 connected to the water outlet pipe 8 and the water is evacuated through this pipe 8.

In fact, the indentations 15*e*, 16*e* brazed to the edges of the tubes 2 are involved in the formation of the water flow channels 3.

It is noted incidentally that the water also flows into volumes V formed by the ends 16*f*, 16*f'* of the small flap 16*b* of the second wall 16; these volumes V can ensure that the water is distributed properly but are not necessary; they are formed primarily because, for reasons of manufacturing cost savings and to make it easier to store them, it is preferable for the L-shaped walls 15, 16 to have strictly identical external forms; thus, some elements can be overabundant but are retained in order to take advantage of the identical nature of the external form of the walls 15, 16.

The end portions (15*f*, 15*f'*), (16*f*, 16*f'*) of the walls 15, 16 are raised with respect to the corresponding indentation 15*e*, 16*e*, in this case over their entire surface. Of course, the extent (in the direction of the length L of the exchanger 1) of these end portions (15*f*, 15*f'*), (16*f*, 16*f'*) can vary. Similarly, their form can vary; for example, the end portions can be conical around the orifice 6, 7 for accommodating a pipe 8, 9; in this case, the end portions 16*f*, 16*f'*, which are not pierced, preferably have the same form, for the reasons explained hereinabove of the identical nature of the external form of the walls 15, 16.

Preferably, the disturbing elements 3' fitted in the water flow channels 3 do not extend, in the direction of the length L of the exchanger 1, as far as the end of the tubes 2 and thus not as far as the headers 10. Thus, a water collection volume without disturbing elements 3' is formed.

One particular feature of the walls 15, 16 will now be described. FIG. 7 shows that, close to the area of contact between the turned-up edge 15*c*, 16*c* of the small flap 15*b*, 16*b* of each wall 15, 16 and the large flap 16*a*, 15*a* of the other wall 16, 15, there is an area where there is a clearance J with respect to the corner of the header 10 (these two diagonally opposed clearances on the exchanger 1 are designated by the same reference, J). It is noted that there is no such clearance at the folding edges 15', 16' between the small and large flaps (15*b*, 16*b*), (15*a*, 16*a*) of the walls 15, 16, inasmuch as the internal surface of this folding edge 15', 16' in this case matches the external surface of the corresponding corner of the header 10.

On account of the existence of these clearances J, there is a risk of water leaking there. It is for this reason that each wall 15, 16 has, close to each of the free corners of its large flap 15*a*, 16*a*, a sealing portion P (all the sealing portions of the exchanger 1 are designated by the same reference, P). Each sealing portion P is in the form of a portion protruding from the internal surface of the large flap 15*a*, 16*a* of the wall 15, 16, in the direction of the tubes 2; this protruding portion P has the form of a corner or fin. Such a protruding portion P can either be pressed onto the wall 15, 16 after its manufacture or be formed directly during the manufacture of the wall 15, 16.

Figure 9:
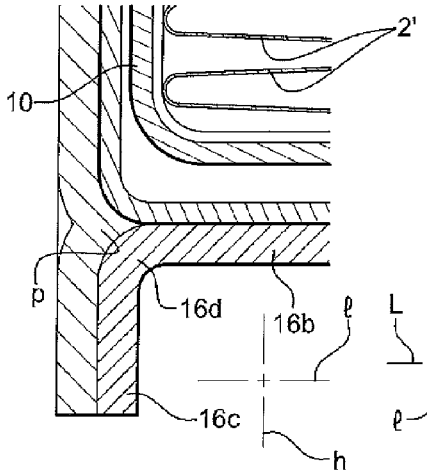
FIG. 9 is an enlarged view of the area A in FIG. 7.

The position and thus the function of this sealing portion P can be readily understood from FIG. 9. It is clearly visible that the sealing portion P is in contact with the external surface of the corner of the header 10 and with the facing surface of the folding edge 16*d* of the turned-up edge 16*c* of the small flap 16*b* of the second wall 16. The various components are brazed at these areas of contact, thereby causing the clearance J there to disappear and preventing any flow of water. The sealing portions P do not extend far in the direction of the length L of the exchanger 1, since it is sufficient that they are present close to the headers 10 to avoid water leakages. Thus, the sealing portions P are designed to fill a clearance J, at the securing area of the wall 15, 16 to which they belong with the other wall 16, 15, between these walls 15, 16 and the headers 10. It goes without saying that what is described in this paragraph is applicable to the four sealing portions P of the exchanger 1.

FIG. 17 shows an L-shaped wall 15 according to one particular embodiment. This wall 15 only has one orifice 6 for connecting to a water pipe 8, in this case the water outlet pipe 8; this orifice 6 is, in the same way as before, formed close to one end of the small flap 15*b* of the wall 15. The other water pipe (the inlet pipe 9) is in this case connected to an orifice formed on the other L-shaped wall (not shown); it is preferably also formed on its small flap and at its end opposite that of the wall 15 shown in FIG. 17.

It is noted that the wall 15 in FIG. 17 has two widened portions E, in the direction of the height h of the exchanger 1, which are formed close to each end of its large flap 15*a*. These widened portions E are in this case formed by pressing the wall 15. They are provided where the dimensions of the header 10 are greater, in the direction of the height h of the exchanger 1, than the dimension of the small flaps 15*b* of the L-shaped walls 15; they are thus widened portions E (or pressings E) for housing the header 10. These pressings E have an additional advantage: inasmuch as they house the headers 10 in the direction of the height h of the exchanger 1, they form an abutment in the dimension of the length L of the exchanger 1; thus, they form means for holding the headers 10 and thus all the exchange elements 2, 2', 3, 3' axially (in this direction L) during the brazing of all the elements of the exchanger 1 (if they are brazed).

It is noted that such widened portions E can be provided on walls in accordance with the embodiment of FIGS. 1 to 10 or with the embodiment of FIGS. 11 to 15. The same is true for the presence of a single orifice 6 for connecting to a water pipe, independently of the presence or absence of widened portions E. Specifically, the difference between the embodiments of FIGS. 1 to 10 and of FIGS. 11 to 15 relates to the way they are secured to the fluid distribution boxes.

The securing of the header box 11 on the exchanger 1 will now be described. The securing of the header box (not shown) located on the right-hand side of the exchanger 1 will not be described, but is of course completely identical.

The header box 11 is held directly by the casing 4 of the exchanger 1. It will be noted that in the embodiments illustrated here, the header box 11 is held inside the casing 4. In other words, in this case the casing 4 covers the header box 11 at least in part. More particularly, the casing 4 encloses the part of the header box 11 located close to (or in contact with) the header 10.

In the embodiment in FIGS. 1 to 10, the header box 11 is made of metal and the casing 4 and the box 11 are brazed together, as can be seen, for example, in FIG. 3; the box 11 may, for example, be made of aluminum. To this end, the end edge of the box 11 intended to be brazed to the casing 4 has a shoulder 17 which acts as an abutment for the ends (in the direction of the length L) of the walls 15, 16 of the casing 4. The shoulder 17 is designed to have a supporting surface having a form complementary to the form of the end of the walls 15, 16 to which the box 11 is brazed, in order that there is continuity of the external surface of the exchanger 1 between the walls 15, 16 of the casing 4 and the header box 11. The shoulder 17 preferably extends over the entire periphery of the edge of the header box 11. Brazing between the casing 4 and the box 11 is thus easy to implement.

The fact that the box 11 is secured directly to the casing 4 reduces the space requirement of the exchanger 1. This is because the header 10 is thus contained inside the volume of the casing 4 and does not protrude therefrom; in other words, the overall dimensions of the exchanger 1 are determined by the dimensions of the casing 4. This results in good optimization of the flow rate of fluid flowing through the exchanger 1 with respect to its space requirement. Specifically, however the header box 11 is secured to the exchanger 1 (directly to the casing or via the header as in the prior art), the maximum flow section of the fluids is always curbed by the dimensions of the casing 4, since all the fluids flow inside the casing 4. Inasmuch as the box 11 is secured directly to the casing 4, the space requirement linked to this link can also be limited to the space requirement of the casing 4; thus the overall space requirement of the exchanger 1 corresponds to the space requirement of the casing 4, which is linked directly to the flow section of the fluids; the space requirement is thus optimized because it is at a minimum for a given passage section for fluids.

Figure 10:
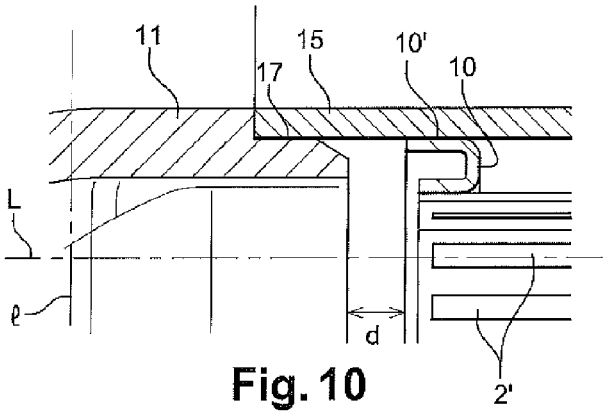
FIG. 10 is a section view in profile of the securing area of the casing and of the distribution box of the exchanger in FIG. 3.
Figure 11:
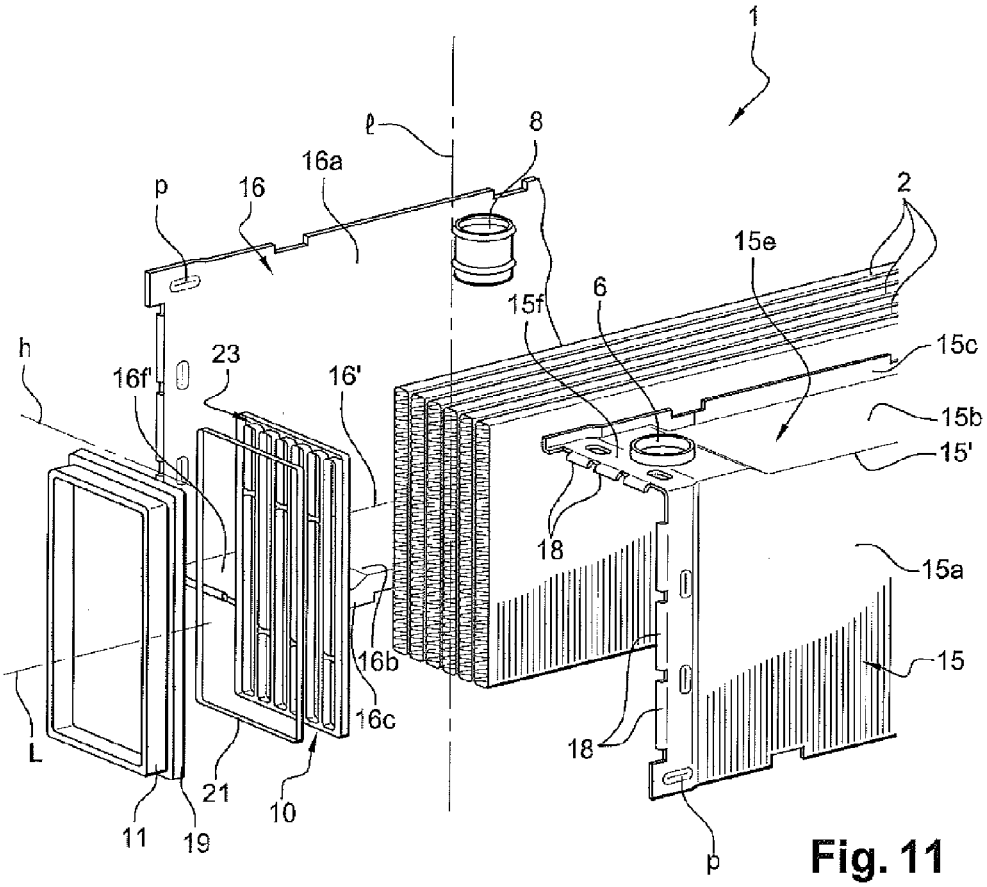
FIG. 11 shows an exploded perspective view of a second embodiment of the exchanger of the invention.
Figure 12:
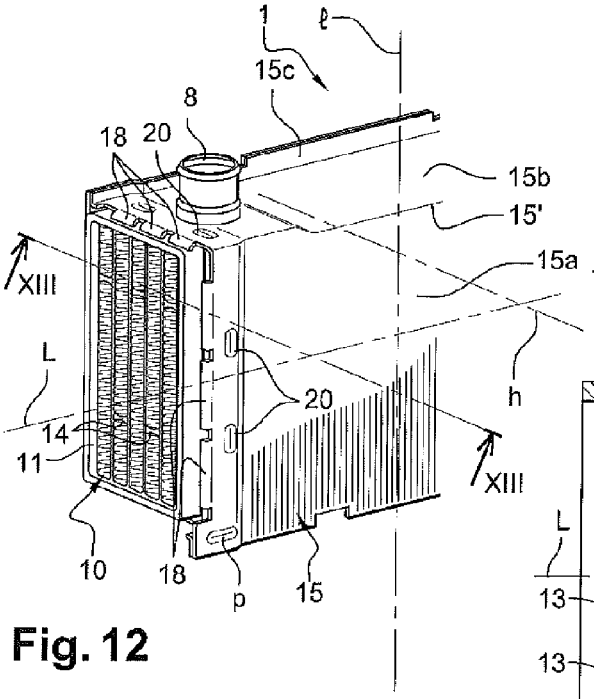
FIG. 12 shows a perspective view of the exchanger in FIG. 11 with its various elements fitted together.
Figure 13:
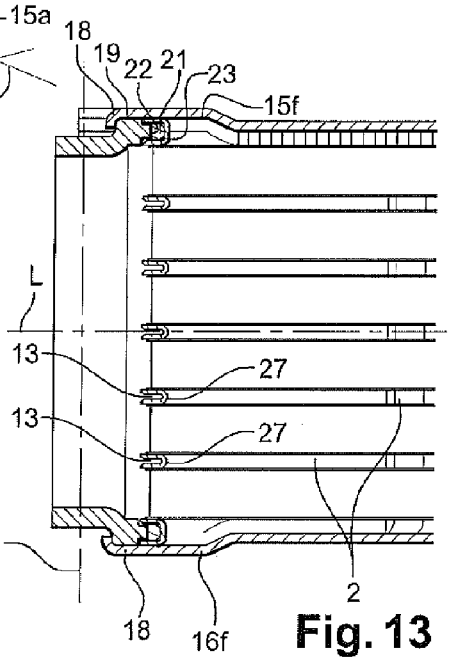
FIG. 13 shows a section view of one end of the exchanger in FIG. 12, along the plane XIII-XIII in FIG. 12.
Figure 14:
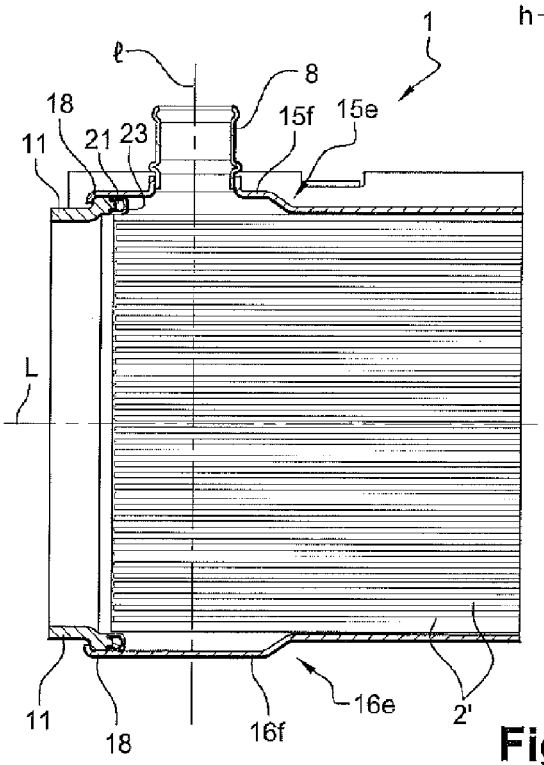
FIG. 14 shows a section view, in profile, of one end of the exchanger in FIG. 12.

It is noted in FIG. 10 that the distance d between the end of the header box 11 and the header 10 is not zero. According to one embodiment, the header box 11, rather than being brazed, can thus be welded to the walls 15, 16 of the casing 4; this is possible since, on account of said distance d, welding does not risk causing the brazing of the tubes 2 to the header 10 to melt.

It is noted that the header 10 is also held by the casing 4, in this case by brazing along the external walls 10' of its peripheral edge.

A second embodiment of the exchanger 1 is described with reference to FIGS. 11 to 15. This embodiment is very similar to the above embodiment, and therefore the references used for the elements of the exchanger in FIGS. 11 to 15, which have an identical, equivalent or similar structure or function to those of the elements of the exchanger in FIGS. 1 to 10, are the same, in order to simplify the description. Furthermore, the entire description of the exchanger in FIGS. 1 to 10 is not repeated, this description applying to the exchanger in FIGS. 11 to 15 when there are no incompatibilities. Only the significant structural and functional differences will be described.

The exchanger 1 in FIGS. 11 to 15 has the following particular feature: the header box 11 (only the end portion of which is visible) of the distribution tank 5, held directly by the casing 4, is secured thereto, not by brazing or welding as described hereinabove, but by crimping.

To this end, the ends (in the direction of the length L of the exchanger 1) of the walls 15, 16 have tabs 18 for crimping the header box 11. In this case, the two flaps (15*a*, 15*b*), (16*a*, 16*b*) of each wall 15, 16 have, at each of their ends, crimping tabs 18; the end edges of each flap (15*a*, 15*b*), (16*a*, 16*b*) each have in this case three crimping tabs 18 distributed uniformly over the edge in question; the crimping tabs 18 of the large flaps 15*a*, 16*a* have larger dimensions than the crimping tabs 18 of the small flaps 15*b*, 16*b*.

The end edge of the header box 11 which is intended to come into contact with the walls 15, 16 of the casing 4 has a supporting rim 19 for the crimping tabs 18; this rim 19 forms an accommodating groove for the crimping tabs 18. The crimping tabs 18 of the casing 4 are curved in order to be crimped in the accommodating groove of the header box 11 and thus directly hold it. The tabs 18 of the casing 4 thus engage with a surface of the header box 11 (the surface of the groove of the rim 19) in order to hold the box 11.

Figure 15:
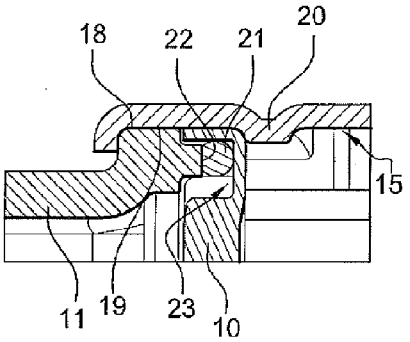
FIG. 15 shows a section view in a plane parallel to the plane of the section in FIG. 14 at an abutment of the casing of the exchanger.

In the preferred embodiment, the header 10 is also held by the casing 4. To this end, the flaps (15*a*, 15*b*), (16*a*, 16*b*) of the walls 15, 16 of the casing 4 have abutments 20, in this case formed by stamping the flaps (15*a*, 15*b*), (16*a*, 16*b*). These abutments 20 protrude from the internal surface of the flaps (15*a*, 15*b*), (16*a*, 16*b*). With reference to FIG. 15, the external edge of the header 10 is wedged, that is to say abutted on both sides (in the direction of the length L of the exchanger 1), between the rim 19 of the header box 11 and the abutments 20 of the walls 15, 16 of the casing 4. In other words, the rim 19 of the header box 11 and the header 10 are held in position between the abutments 20 and the crimping tabs 18 of the walls 15, 16 of the casing; thus, by the effect of the crimping, the tabs 18 apply stress to the header box 11 and the header 10 such that said header box and header are locked in position between the latter and the abutments 20. In this case, two abutments 20 are provided close to the end of each flap (15*a*, 15*b*), (16*a*, 16*b*) of each wall 15, 16.

In accordance with the embodiment shown, a seal 21 is inserted between the end edge 22 of the edge of the header box 11 and a groove 23 formed at the periphery of the header 10; this groove 23 extends over the entire periphery of the edge of the header 10; it has a U-shaped section, the opening of which is turned toward the side of the header box 11. This seal 21 ensures air tightness between the header box 11 and the header 10. It is made, for example, of elastomer.

It is noted incidentally that the view in FIG. 15 is a section in a plane located, at one abutment 20, between two necks 13. It is for this reason that a space can be seen in this figure on the inside of the seal 21. This space is only present between two necks 13 and it can be seen from the other figures that the seal 21 is otherwise compressed well in the groove 23 of the header 10, thus correctly fulfilling its sealing function.

According to an alternative embodiment, the seal between the header box 11 and the header 10 to which it is secured is ensured by brazing. To this end, the end edge 22 of the edge of the header box 11 is brazed directly in the groove 23. An exchanger 1 is thus obtained with the casing 4 crimped to the header box 11, the latter being brazed to the header 10. In other words, the sealing means between the header 10 and the header box 11 comprise a brazing link.

Whatever the embodiment (sealing by seal or by brazing), the exchanger 1 having its casing 4 crimped to its header box 11 has all the advantages, laid out hereinabove in relation to the first embodiment where they are brazed, linked to the header box 11 being held directly by the casing 4. It also has all the advantages linked to securing by crimping. In particular, it is possible to provide a header box 11 made of plastic, this not being possible in the context of securing by brazing or welding, for which the box 11 must be made of metal; of course the securing of the header box 11 to the casing 4 by crimping can also be implemented with a metal box 11.

It is noted that such crimping of the header box 11 by the casing 4 has an additional advantage over crimping, known from the prior art, between a header and a header box: the thickness of the walls 15, 16 of the casing 4 of an exchanger 1 is generally greater than the thickness of the wall forming its header 10 (for example 1 mm for the wall of the header 10 versus 2 mm for the wall of the casing 4); this is all the more true for a metal header 10, made for example of aluminum, which has already been subjected to a thermal treatment in order to braze it to the other elements, said treatment having reduced its mechanical strength. Since it is done directly by the casing 4, securing by crimping is stiffer and there is no risk of deformation. In addition, the header 10 is not stressed and there is therefore no risk of it deforming.

The exchanger 1 (whatever its embodiment) functions as follows (this is described succinctly since it is well known to a person skilled in the art). Air is supplied at the air inlet distribution tank 5, flows through the tubes 2 (this flow being disturbed by the fins 2') and exits the exchanger 1 through the air outlet distribution tank (not shown). Furthermore, the exchanger is supplied with water through the water inlet pipe 9, the water flows through the water flow channels 3 (this flow being disturbed by the disturbing elements 3') and exits the exchanger 1 through the water outlet pipe 8. The air and water flow in countercurrent in the direction of the length L of the exchanger 1; this is known as a "counter-current" heat exchanger; the efficiency of such an exchanger 1 is very good.

The heat exchanger 1 has been described in relation to air flowing in its tubes 2 and water flowing between the tubes across the disturbing elements 3'. It goes without saying that this could be reversed, that is to say with water in the tubes and air between the tubes. Furthermore, there could be air in both cases or water in both cases, or other fluids.

The various features, described hereinabove, of the various elements of the exchanger can be combined or provided independently of one another, when this is compatible.

The invention claimed is:

1. A heat exchanger having exchange elements (2, 2', 3, 3') and a casing (4) for accommodating the exchange elements (2, 3'), the casing (4) formed by a plurality of walls (15, 16) connected together, wherein the casing (4) has two L-shaped walls (15, 16), wherein a first wall (15) has a first flap (15*a*) that extends in a first direction and a second flap (15*b*) of the first wall (15) that extends from the first flap (15*a*) in a second direction perpendicular to the first direction, wherein a second wall (16) has a third flap (16*a*) that extends in a third direction opposite to the first direction and a fourth flap (16*b*) of the second wall (16) that extends from the third flap (16*a*) in a fourth direction perpendicular to the third direction and opposite the second direction, wherein the second flap (15*b*) has a first turned-up edge (15*c*) perpendicular to the second flap (15*b*) that extends in the third direction for securing the first turned-up edge (15*c*) to the third flap (16*a*) and the fourth flap (16*b*) has a second turned-up edge (16*c*) perpendicular to the fourth flap (16*b*) that extends in the first direction for securing the second turned-up edge (16*c*) to the first flap (15*a*), wherein the first flap (15*a*) has a length greater than a length of the second flap (15*b*) and the third flap (16*a*) has a length greater than a length of the fourth flap (16*b*), wherein an inlet pipe (8) and outlet pipe (9) are connected to a single face of either one of the second flap (15*b*) and the fourth flap (16*b*), wherein one of the second and fourth flaps (15*b*, 16*b*) has an indentation (15*e*, 16*e*) which is designed to come into contact with flow tubes (2), which are assembled in parallel, for a first fluid and thus to form flow channels (3) for a second fluid between the flow tubes (2), and wherein, with the one of the second and fourth flaps (15*b*, 16*b*) having the indentation (15*e*, 16*e*) also having at least one orifice (6, 7) for connecting to a flow circuit for the second fluid, the at least one orifice (6, 7) is formed on a portion ((15*f*, 15*f*), (16*f*, 16*f*)) of the second and fourth flaps (15*b*, 16*b*) which is separate from the indentation (15*e*, 16*e*) in order to enable better distribution of the second fluid in its flow channels (3).

* * * * *